US005497583A

United States Patent [19]

Rhoads

[11] Patent Number: 5,497,583

[45] Date of Patent: Mar. 12, 1996

[54] CYLINDRICAL RAIN GUTTER

[76] Inventor: Rodney E. Rhoads, 331 Dead End Rd., Lititz, Pa. 17543

[21] Appl. No.: 292,463

[22] Filed: Aug. 18, 1994

[51] Int. Cl.[6] ..... E04D 13/064

[52] U.S. Cl. ..... 52/12; 52/11

[58] Field of Search ..... 52/11, 12

[56] References Cited

U.S. PATENT DOCUMENTS

| | | | |
|---|---|---|---|
| 4,455,791 | 6/1984 | Elko et al. | 52/12 |
| 4,493,588 | 1/1985 | Duffy . | |
| 4,497,146 | 2/1985 | Demartini . | |
| 4,571,896 | 2/1986 | Condie | 52/12 |
| 4,757,649 | 7/1988 | Vahldieck | 52/12 |
| 5,016,404 | 5/1991 | Briggs . | |
| 5,099,620 | 3/1992 | Carey . | |
| 5,261,196 | 11/1993 | Buckenmaier et al. | 52/12 X |

*Primary Examiner*—Carl D. Friedman
*Assistant Examiner*—W. Glenn Edwards
*Attorney, Agent, or Firm*—Weiner, Carrier & Burt; William F. Esser; Irving M. Weiner

[57] ABSTRACT

A rain gutter which collects water from a roof portion and prevents other objects from entering therein, comprising an elongated tubular member having an opening defined longitudinally therealong; a flashing member which operatively connects to a lower roof portion and the upper surface of the tubular member so as to provide fluid communication therebetween; and a plurality of spikes inserted through an upper portion of the tubular member, for attaching to a roof portion or support therefor.

13 Claims, 1 Drawing Sheet

CYLINDRICAL RAIN GUTTER

BACKGROUND OF THE INVENTION

1. Field of Invention

This invention relates to a rain gutter device, and particularly to a rain gutter device which receives water within the rain gutter and prevents other objects from entering therein.

2. Description of the Relevant Art

There are known rain gutters and attachments therefor which are adapted to prevent objects from entering therein. For example, Demartini U.S. Pat. No. 4,497,146 discloses a rain gutter deflector adapted for use with conventional rain gutters. Demartini, however, fails to disclose a rain gutter being simple in construction, and having a water deflector defined integrally therewith comprising a cylindrical member with an opening defined therealong.

Duffy U.S. Pat. No. 4,493,588 discloses a non-clogging caves trough, but fails to disclose an inexpensive rain gutter comprising a substantially cylindrical trough member having an opening defined longitudinally along the outwardly facing surface thereof for receiving rain water within the trough member.

Briggs U.S. Pat. No. 5,016,404 discloses a gutter, deflector, and bracket assembly, but fails to disclose an inexpensive rain gutter having a water deflector defined integrally therewith, comprising a hollow cylindrical trough having an opening defined longitudinally along the outer surface thereof.

Carey U.S. Pat. No. 5,099,620 discloses a cover for a rain gutter. Carey, however, fails to disclose a rain gutter which is simple in construction, comprising a tubular water collecting member having a slot defined longitudinally therealong.

SUMMARY OF THE INVENTION

The present invention overcomes the above-discussed limitations and shortcomings of known rain gutters and satisfies a significant need for a rain gutter which replaces existing rain gutters and requires substantially no maintenance therefor.

According to the invention, there is provided a rain gutter having an elongated, substantially cylindrical tubular portion adapted to be operatively attached to the lower edge of a roof portion, having an opening defined longitudinally along an outwardly facing surface thereof. The edges defining the opening are tapered so as to effectively direct the flow of water into the tubular portion. The invention further includes a flashing member having one end attached to the lower edge of the roof portion and a second end, opposite the first end, associated with the upper, outwardly facing surface of the tubular member, so as to provide fluid communication therebetween.

In use, the rain gutter is first operatively connected to a roof portion, by attaching the tubular portion to a roof support, positioning the opening thereof so as to face substantially outwardly, and connecting the flashing member between the roof edge and the upper, outwardly facing surface of the tubular portion. Thereafter, rain flowing from the lower edge of the roof to the upper, outwardly-facing surface of the tubular member will follow the contour of outwardly-facing surface leading to the tubular member opening, whereupon the water will fall into the tubular portion. Other debris, such as leaves or tree branches, will likewise follow the rainfall path from the roof to the upper surface of the tubular portion, but will thereupon fall to the earth instead of tracing the inwardly-curving contour of the outwardly facing exterior surface of the tubular portion. In this way, water flowing from the roof is collected within the tubular portion while other debris falls harmlessly to the ground, thereby substantially preventing the tubular portion from clogging or otherwise requiring periodic maintenance therefor.

It is an object of the invention to provide a rain gutter which reliably receives water flowing from a roof portion and substantially prevents other debris from being collected therein.

It is another object of the invention to provide a rain gutter which is simple in construction and inexpensive to manufacture.

Another object of the invention is to provide a rain gutter having a means for substantially preventing clogging thereof which is formed integrally with the rain gutter so as to form a unitary member.

Other objects, advantages and salient features of the present invention will become apparent from the following detailed description, which, when taken in conjunction with the annexed drawings, discloses preferred embodiments of the present invention.

DETAILED DESCRIPTION OF THE INVENTION

Figure 1:
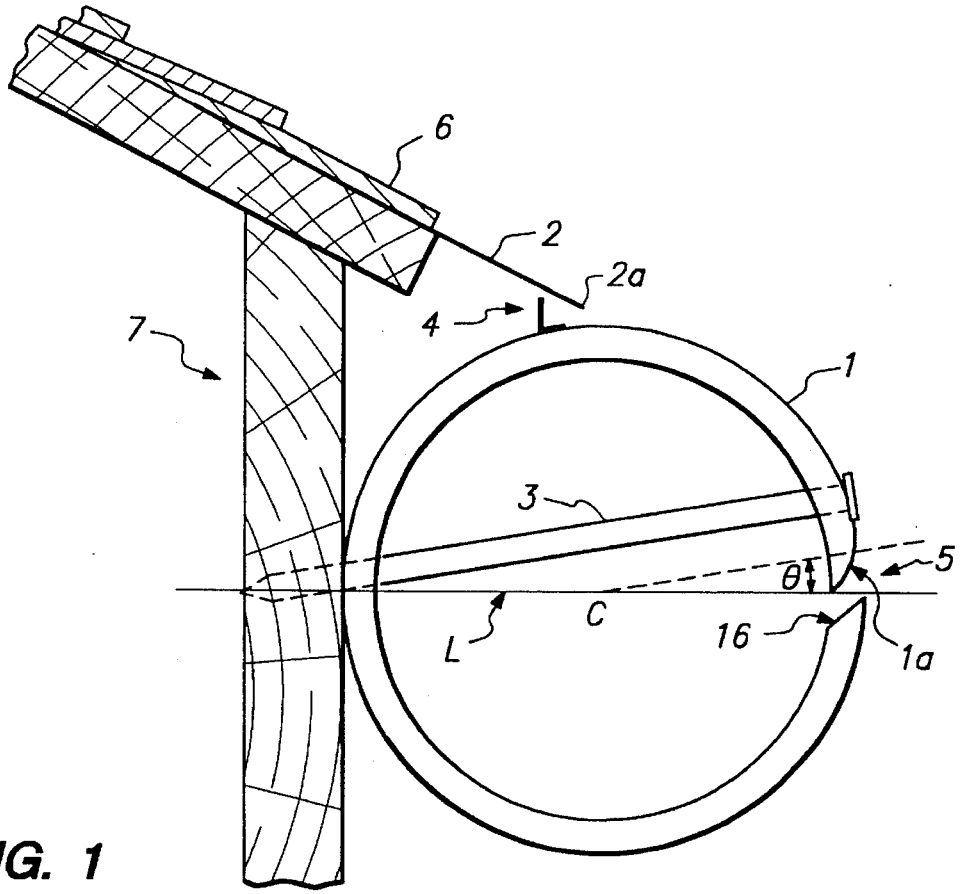
FIG. 1 is a side elevational view of a preferred embodiment of the present invention.
Figure 2:
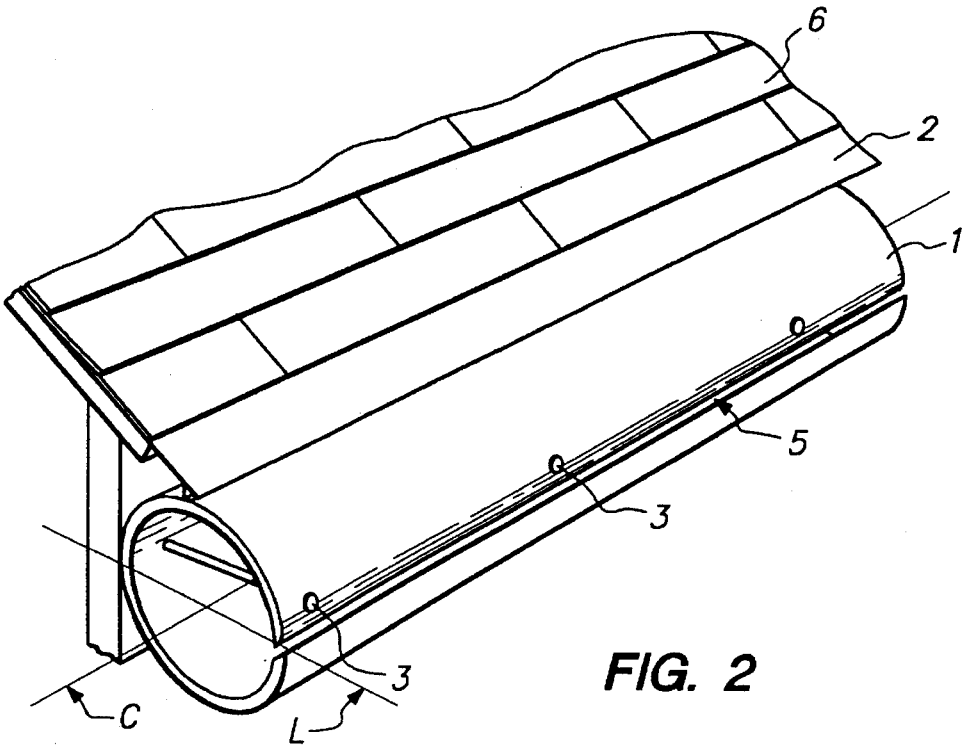
FIG. 2 is a perspective view thereof.

Referring to FIGS. 1 and 2, there is shown a rain gutter, comprising trough member 1, flashing member 2, spikes 3, and flow control baffle 4.

Trough member 1 is preferably but not necessarily substantially cylindrical in shape, but alternatively trough member 1 is comprised of other shapes having curved, convex outwardly facing surfaces, such as oval or oblong shaped cross sections. Trough member 1 is preferably but not necessarily constructed from a substantially weather resistant material, such as plastic, fiberglass, adequately treated sheet metal, or the like. In a preferred embodiment of the invention, trough member 1 comprises PVC tubing, which is widely available in a wide variety of sizes, and is very inexpensive compared to tubing constructed from other materials. Although the diameter of trough member 1 is selected according to its application, for example trough member 1 is between approximately 3" and 4" in diameter.

A preferred embodiment of the present invention includes means for collecting rain water flowing from a roof portion within trough member 1, and for preventing other articles, such as twigs or leaves, from accumulating therein. Such collecting means preferably but not necessarily comprises opening 5, which is defined longitudinally along trough member 1, as shown in FIGS. 1 and 2. The width of opening 5 is defined by edges 1*a* and 1*b* of trough member 1.

Trough member 1 is preferably attached along a lower roof portion so that opening 5 is positioned on an outwardly facing, exposed surface, as shown in FIGS. 1 and 2. The optimal orientation of trough member 1 relative to roof 6 and roof support 7 is such that water flowing from roof 6 onto the upper, outwardly facing exterior surface of trough member 1 follows the outer contour thereof until encountering opening 5, whereupon water is collected therewithin. In this way, rainfall from roof 6 will be substantially collected in trough member 1.

The optimal orientation of trough member 1 (and corresponding opening 5) relative to roof 6 and roof support 7 depends in large part upon the characteristics of roof 6, such as its size and pitch. This is because such characteristics of roof 6 effect the velocity of water flowing therefrom, thereby determining in part the extent to which the water follows the outer contour of trough member 1. As a result, the optimal orientation of trough member 1 occurs in ranges. Accordingly, trough member 1 is preferably but not necessarily oriented relative to roof 6 and roof support 7 such that opening 5 is positioned at an angle between approximately 0° and 40° from a lateral horizontal axis L which laterally intersects trough member 1 through its center longitudinal axis C, as shown in FIG. 1. Angle preferably increases relative to axis L as the pitch of roof 6 increases.

The preferred embodiment of the present invention includes means for attaching trough member 1 to roof 6 or roof support 7. Such attaching means preferably but not necessarily includes a plurality of spikes 3, which are inserted laterally through trough member 1 and penetrate roof 6 or roof support 7, as shown in FIGS. 1 and 2. Spikes 3 are preferably spaced along trough member 1 at a fixed distance between adjacent spikes 3.

A plurality of apertures are defined along trough member 1 for receiving spikes 3. In a preferred embodiment, such apertures are predrilled in order to provide convenient installation of the rain gutter. Additional apertures may be optionally drilled in order to provide adjustable orientation of trough member 1 and corresponding opening 5.

Alternatively, other attaching means, such as screws or rivets, attach trough member 1 to roof 6 or roof support 7 by being inserted therethrough.

The attaching means preferably extend substantially laterally through an upper portion of trough member 1 so as to minimize the possibility of water leakage thereby.

According to the preferred embodiment of the present invention, trough member 1 directly attaches to roof 6 or roof support 7 in order to effectively collect water flowing from roof 6, but alternatively trough member 1 attaches thereto by indirect attaching means. For example, in cases in which roof 6 extends substantially outwardly from roof support 7, a spacer may be used to extend trough member 1, outwardly from roof support 7 so as to operatively align with roof 6. In another alternative embodiment, trough member 1 includes an oblong or oval shaped cross section so as to effectively align with substantially extending roof 6.

The rain gutter device according to the present invention preferably but not necessarily includes a means for effectively providing fluid communication between roof 6 and the upper, outwardly facing exterior surface of trough member 1. Such fluid communication means preferably but not necessarily includes flashing member 2, which comprises a substantially flat sheet of noncorrosive material having a first end which is connected to roof 6 and a second end **2*a*, opposite the first end, which is associated with the upper surface of trough member 1. Flashing member 2 preferably but not necessarily extends the entire length of trough member 1**.

The first end of flashing member 2 is preferably inserted under the tiles comprising the lower portions of roof 6, as shown in FIGS. 1 and 2, so that water flowing therefrom proceeds substantially uninterruptedly along flashing member 2. Flashing member 2 extends over a major portion of trough member 1 so that second end **2*a* of flashing member 2 is positioned over or contacts the upper surface of trough member 1 (FIG. 1). Flashing member 2 preferably extends over at least half of trough member 1 so that water flowing from flashing member 2 flows down the outwardly facing exterior surface of trough member 1. The optimal position of the second end 2*a* relative to trough member 1 additionally depends upon the characteristics of roof 6**, such as its length and pitch.

Referring to FIG. 1, there is provided flow control baffle 4, which is preferably positioned on an upper surface of trough member 1 and extends substantially upwardly and outwardly therefrom. Baffle 4 is adapted to prevent any flow of water along the inwardly facing exterior surface of trough member 1. The optimal height of baffle 4 and its position along the upper surface of trough member 1 depends upon the relationship between flashing member 2 and trough member 1, as well as the characteristics of roof 6, but is preferably a fixed height so as to reduce manufacturing costs. In the preferred embodiment, baffle 4 protrudes substantially upwardly from trough member 1 for substantially the entire length of thereof. The upper tip of baffle 4 may additionally provide vertical support for the lower portion of flashing member 2, and may be integrally connected to trough member 1 so as to form a unitary member therewith.

According to the preferred embodiment of the present invention, trough member 1 includes an outwardly facing surface which is substantially convex, having a curved portion which initially extends downwardly and outwardly, and then extends downwardly and inwardly, at which point the path of water flow separates from the path of other debris. The water continues to flow along the inwardly extending portion, eventually passing through opening 5 into the water collecting portion of trough 1, while the other debris falls harmlessly to the ground due to gravitational forces acting thereon and its inability to adhere to the inward curvature of trough member 1.

In order to effectively provide such separation between the path of water flow and the path of other debris, edge **1*a* of trough member 1 is preferably but not necessarily tapered downwardly and inwardly, as shown in FIG. 1. Further, edge 1*b* of trough member 1 is tapered or cut at an angle so that water falling from the tip of edge 1*a* is substantially retained within trough member 1**.

The degree of the tapered or angled cut of edges **1*a* and 1*b* may vary depending upon the specific application, but preferably such taper is predetermined so as to substantially minimize manufacturing costs. By way of example, edges 1*a* and 1*b* are each tapered or cut from the exterior surface of trough member 1** to its interior surface at an approximately 45° angle, relative to a horizontal axis.

According to the preferred embodiment of the present invention, the rain gutter device additionally includes fittings for effectively directing water contained in trough member 1 to a ground surface. Such fittings, such as fittings used for providing fluid communication to downspouts, preferably but not necessarily operatively connect to an end of trough member 1 and includes an opening defined longitudinally along a horizontal section thereof.

Although trough member 1 is preferably substantially cylindrical so as to operatively attach to a lower roof portion which is substantially linear, alternatively trough member i includes means for conforming to a nonlinear surface, comprising curved trough members having an opening defined therealong.

In use, trough member 1 is first attached to roof 6 or roof support 7 by orienting trough member 1 relative thereto so that opening 5 is positioned at the appropriate and/or predetermined angle along the outwardly facing surface thereof with baffle 4 extending substantially upwardly, inserting spikes 3 through the corresponding predrilled holes therefor located along the upper portion of trough member 1, and hammering the ends of spikes 3 into roof 6 or roof support 7.

Next, a first end of flashing member 2 is inserted under the lowermost tiles of roof 6, and flashing member 2 is slidably adjusted thereunder so that it extends over at least half of trough member 1 and second end 2*a* of flashing member 2 is positioned over or contacts with the upper surface of trough member 1.

Thereafter, water and other debris accumulated on roof 6 flow downwardly onto flashing member 2 and onto the upper, outwardly-facing exterior surface of trough member 1 so as to follow the downward and outward contour thereof. As the contour of trough member 1 curves inwardly, the flowing water separates from the other debris by following the inward curve into opening 5, while the debris falls harmlessly downwardly to the ground.

Although there have been described what are at present considered to be the preferred embodiments of the present invention, it will be understood that the invention can be embodied in other specific forms without departing from the spirit or essential characteristics thereof.

The described embodiments are, therefore, to be considered in all aspects as illustrative, and not restrictive. The scope of the invention is indicated by the appended claims rather than the foregoing description.

I claim:

1. A device for collecting and channeling water from a roof, comprising:

an elongated first member;

means for operatively connecting the first member to an edge of the roof portion;

means for allowing rainfall from the roof to be collected in said first member, and for substantially preventing other debris from collecting therein;

wherein said first member is substantially cylindrical;

said allowing means comprises a slot defined substantially longitudinally along said first member;

a first edge of said first member defining an upper extent of said slot is tapered substantially inwardly so as to allow fluid flowing along an outer surface of said first member to flow therein;

a second edge of said first member defining a lower extent of said slot is tapered substantially inwardly;

said slot faces substantially outwardly from the roof portion so that rain water flowing from the roof portion flows along an outwardly facing surface of said first member and enters said first member via said slot; and said first member and said allowing means are integrally connected so as to form a unitary member.

2. A device as recited in claim 1, wherein:

said connecting means includes a flashing member having a first end which is attachable to the roof edge portion and a second end which is disposed proximal to an upper portion of said first member so that an upper surface of said flashing member provides fluid communication between the roof portion and an outwardly facing surface of said first member.

3. A rain gutter, comprising:

at least one substantially cylindrical first trough member;

means, connected to said first trough member, for attaching said trough member to a roof support;

means for receiving rainfall in said first trough member, and for substantially preventing other debris from entering into said first trough member;

said rainfall receiving means includes an elongated opening defined substantially longitudinally along an outwardly facing surface of said first trough member relative to a roof support:

an exterior surface of said first trough member is tapered inwardly at a first edge defining said opening so as to allow water flowing downwardly over an outer surface of said trough member to flow therein;

a substantially planar flashing member attachable between a lower portion of the roof and an upper surface of said first trough member at a substantially outwardly facing portion thereof, so as to provide fluid communication between the lower roof portion and said upper outwardly facing exterior surface of said first trough member; and said opening is disposed substantially longitudinally along said first trough member between approximately 0° and 40° from a horizontal axis extending laterally through a center longitudinal axis of said first trough member so as to allow fluid from the roof to flow downwardly along an outer surface of said first trough member and enter therein via said opening.

4. A rain gutter as recited in claim 3, wherein:

a second edge defining said opening of said first trough member is tapered.

5. A rain gutter as recited in claim 3, wherein:

said attaching means comprises a plurality of spikes, each of said spikes extending substantially laterally through an upper portion of said first trough member and partially penetrateable said roof support.

6. A rain gutter as recited in claim 3, including:

second means, connected along said upper surface of said first trough member and disposed substantially inwardly of said flashing member, for substantially preventing rainwater from following an inwardly facing surface of said first trough member.

7. A rain gutter as recited in claim 6, wherein:

said first trough member, said receiving means, and said second means are integrally formed so as to comprise a unitary member.

8. A device for collecting and channeling water flowing from an inclined surface, comprising:

a substantially cylindrical tubing member attachable along a lower edge portion of the inclined surface;

means, connected to said tubing member, for providing fluid communication between said lower edge portion of said inclined surface and an outwardly facing exterior surface of said tubing member, relative to said inclined surface;

means for substantially receiving water flowing along said outwardly facing exterior surface of said tubing member within said tubing member; and said outwardly facing exterior surface of said tubing member has a substantially circular cross-section; and wherein said receiving means comprises an opening defined substantially longitudinally along said outwardly facing portion of said tubing member relative to the inclined surface, wherein an upper edge defining said opening is tapered substantially inwardly for directing water from said outwardly facing surface into said tubing member.

9. A device as recited in claim 8, wherein:

said opening is longitudinally disposed between approximately 0° and 40° from a lateral horizontal axis intersecting a center longitudinal axis of said tubing member.

10. A device as recited in claim 8, wherein:

a lower edge defining said opening is tapered substantially inwardly.

11. A device as recited in claim 8, further including:

means, connected to said tubing member substantially inwardly from said fluid communication means, for preventing rain water from flowing downwardly along an inwardly facing surface of said tubing member.

12. A device as recited in claim 11, wherein:

said preventing means and said tubing member are integrally formed as a unitary member.

13. A device as recited in claim 2, further including:

means, connected to said first member substantially inwardly from said flashing member, for substantially preventing water from flowing along an inwardly facing exterior surface of said first member; and said preventing means and said first member are integrally formed as a unitary member.

* * * * *